US011220926B2

(12) United States Patent
Mariotti et al.

(10) Patent No.: US 11,220,926 B2
(45) Date of Patent: Jan. 11, 2022

(54) APPARATUS FOR SEALING AN INTERNAL ENVIRONMENT OF A TURBOMACHINE

(71) Applicant: Nuovo Pignone Srl, Florence (IT)

(72) Inventors: Gabriele Mariotti, Florence (IT); Rosaria Giordano, Florence (IT); Lucrezia Bianco, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 445 days.

(21) Appl. No.: 15/105,155

(22) PCT Filed: Dec. 16, 2014

(86) PCT No.: PCT/EP2014/077892
§ 371 (c)(1),
(2) Date: Jun. 16, 2016

(87) PCT Pub. No.: WO2015/091434
PCT Pub. Date: Jun. 25, 2015

(65) Prior Publication Data

US 2016/0312647 A1 Oct. 27, 2016

(51) Int. Cl.
*F01D 17/10* (2006.01)
*F01D 25/18* (2006.01)
(Continued)

(52) U.S. Cl.
CPC ..... *F01D 17/10* (2013.01); *F01D 25/16* (2013.01); *F01D 25/186* (2013.01); *F01M 1/12* (2013.01);
(Continued)

(58) Field of Classification Search
CPC ..... F01D 25/18; F01D 25/183; F01D 25/186; F01D 25/20; F05D 2260/609
See application file for complete search history.

(56) References Cited

U.S. PATENT DOCUMENTS 2,910,328 A * 10/1959 Frolich ..... F01D 11/04 277/412
3,349,999 A * 10/1967 Kirtland ..... F04D 29/063 415/113
(Continued)

FOREIGN PATENT DOCUMENTS

GB 269148 A * 2/1928 ..... C10M 175/0091
RU 2 443 883 C2 2/2012
WO 2011024375 A1 3/2011

OTHER PUBLICATIONS

Italian Search Report and Written Opinion issued in connection with corresponding Italian Application No. ITCO20130070 dated Mar. 19, 2014.
(Continued)

*Primary Examiner* — Woody A Lee, Jr.
*Assistant Examiner* — Brian O Peters
(74) *Attorney, Agent, or Firm* — Baker Hughes Patent Organization

(57) ABSTRACT

An apparatus for sealing an internal environment of a turbomachine includes a first chamber connectable in fluid communication with a high pressure environment of a turbomachine so that a working fluid can flow from the high pressure environment to the first chamber; and a second chamber in fluid communication with a lubrication circuit so that a lubricant can flow from the lubrication circuit to the second chamber. The first and second chambers are arranged in fluid communication with each other so that the working fluid can flow from the first to the second chamber. A return line for the working fluid is in fluid communication with the first chamber and connectable in fluid communication with a low pressure environment of the turbomachine so that the working fluid can flow from the first chamber to the low pressure environment. A pressure regulating device is
(Continued)

included along the return line and is configured to provide a predetermined pressure drop.

10 Claims, 1 Drawing Sheet

(51) Int. Cl.
*F01M 1/12* (2006.01)
*F01D 25/16* (2006.01)

(52) U.S. Cl.
CPC ..... *F05D 2220/32* (2013.01); *F05D 2240/55* (2013.01); *F05D 2260/609* (2013.01); *F05D 2260/98* (2013.01)

(56) References Cited

U.S. PATENT DOCUMENTS 3,831,381 A * 8/1974 Swearingen ..... F01D 11/04 60/657
4,050,237 A * 9/1977 Pall ..... B01D 39/2017 60/39.08
4,477,223 A * 10/1984 Giroux ..... F01D 11/02 277/348
4,495,035 A * 1/1985 Swearingen ..... B01D 3/34 203/2
4,606,652 A 8/1986 Swearingen
4,722,663 A * 2/1988 Swearingen ..... F01D 11/06 277/432
2005/0188694 A1 9/2005 Frankenstein

OTHER PUBLICATIONS

International Search Report and Written Opinion issued in connection with corresponding Application No. PCT/EP2014/077892 dated Feb. 12, 2015.
Decision To Grant issued in connection with corresponding RU Application No. 2016123077 dated Oct. 31, 2018.
Office Action and Search issued in connection with corresponding RU Application No. 2016123077 dated Jul. 2, 2018.

* cited by examiner

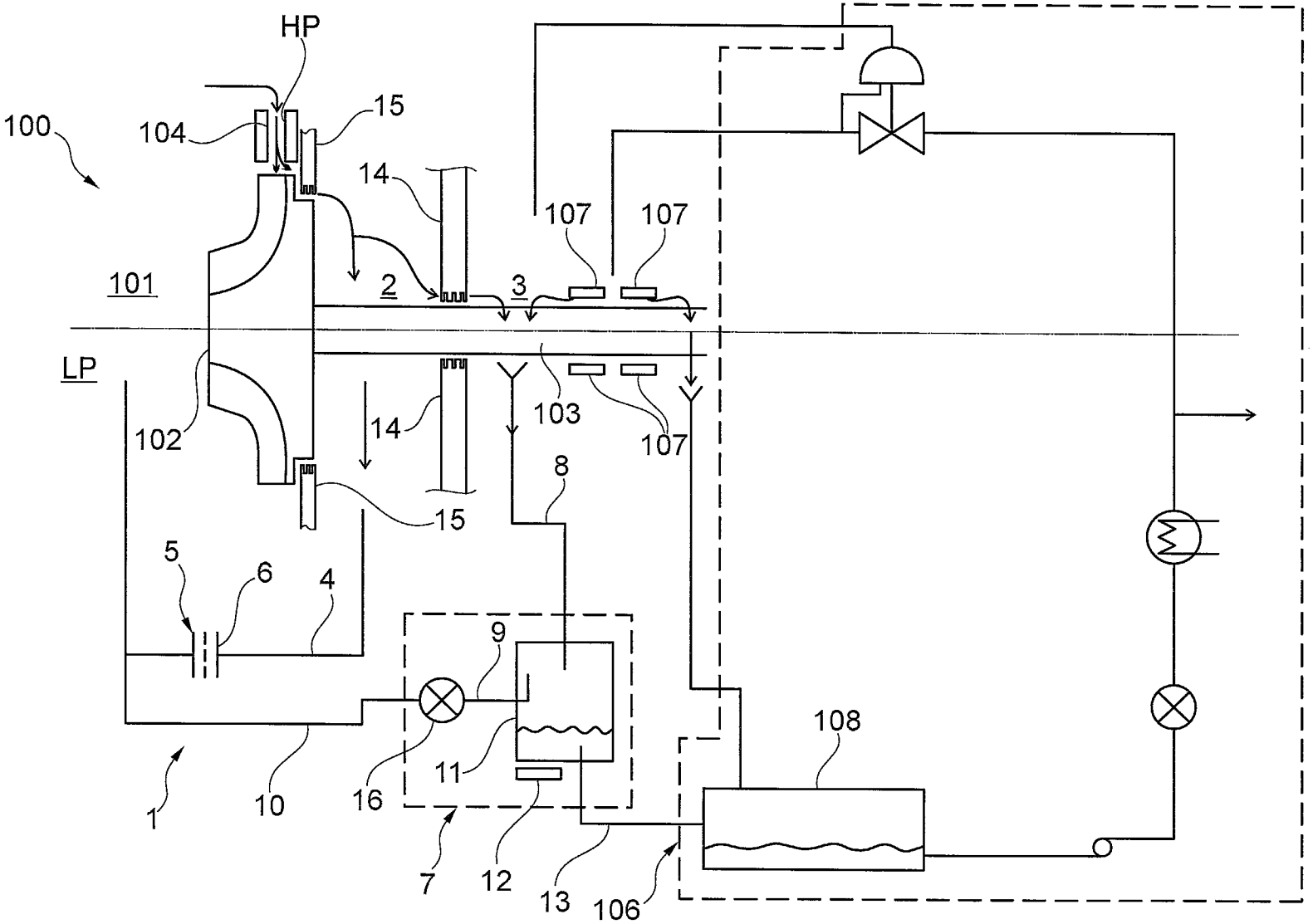
HP
LP
100
101
102
103
104
106
107
108
1
2
3
4
5
6
7
8
9
10
11
12
13
14
15
16

APPARATUS FOR SEALING AN INTERNAL ENVIRONMENT OF A TURBOMACHINE

BACKGROUND

Embodiments of the present invention relate to an apparatus for sealing an internal environment of a turbomachine. Specifically, the apparatus according to embodiments of the invention relate to a seal on a rotating shaft of a turbomachine. With additional detail, the purpose of the seal is to prevent the escape of a working fluid from the turbomachine into the external environment. While the apparatus according to the embodiments of the present invention can be applied to any kind of turbomachine, it is particularly useful for turbines, specifically for ORC (Organic Rankine Cycle) turbines.

In detail, a turbomachine includes a rotor, an inlet and an outlet for the working fluid. The working fluid may be in different phases, for example may be a vapor in the inlet and can be entirely or partially condensed in the outlet. The rotor is placed between the inlet and the outlet, and is attached to a shaft. There is therefore the need to adequately seal an internal environment of the turbomachine with respect to the external environment, particularly if the working fluid is toxic, pollutant or otherwise damaging to the external environment.

It is therefore known in the state of the art an apparatus for sealing an internal environment of a turbomachine. In the context of the present disclosure, the term "internal environment" is to be understood as every part of the turbomachine in which the working fluid is present during normal functioning.

The apparatus itself includes a first chamber in fluid communication with the inlet of the turbomachine. During normal functioning, the first chamber is kept at a lower pressure than the inlet of the turbine, so that the working fluid can flow from the inlet to the first chamber. Usually, the first chamber is placed adjacent to the shaft, behind the rotor.

A second chamber is placed in fluid communication with a lubrication circuit. Therefore, a lubricant from the lubrication circuit fills the second chamber. The second chamber is also adjacent to the shaft, next to the first chamber. A seal is interposed between the first and the second chamber, for example a labyrinth seal. As it is typical with non-contact seals, a certain amount of leakage will be present. Since the lubricant inside the second chamber is kept at a lower pressure than the working fluid in the first chamber, the working fluid will leak into the second chamber from the first chamber.

A mixture of lubricant and working fluid will therefore have to be extracted from the second chamber, and discharged into a reservoir. This reservoir is kept at ambient pressure. Therefore the working fluid, which typically has a much lower evaporation temperature than the lubricant, evaporates. The vapor gathers in an upper zone of the reservoir, from which it is extracted and recompressed so that it can be reinserted into the internal environment of the turbomachine, typically in or near the outlet.

A disadvantage of the known apparatus is that the working fluid is allowed to decompress up to atmospheric pressure, thereby wasting part of its internal energy. Such energy has to be resupplied again by the compressor, thus decreasing the efficiency of the whole turbomachine.

BRIEF DESCRIPTION

A first aspect of the invention is therefore an apparatus for sealing an internal environment of a turbomachine. Such apparatus includes a first chamber connectable in fluid communication with high pressure environment of a turbomachine so that a working fluid can flow from the high pressure environment to the first chamber. The apparatus also includes a second chamber in fluid communication with a lubrication circuit so that a lubricant can flow from the lubrication circuit to the second chamber. The first and the second chambers are arranged in fluid communication with each other, so that the working fluid can flow from the first to the second chamber. The apparatus includes a return line in fluid communication with the first chamber. The return line is connectable in fluid communication with a low pressure environment of a turbomachine. Therefore, the working fluid can flow from the first chamber to the low pressure environment. The apparatus also includes a pressure regulating device configured to provide a predetermined pressure drop along the return line.

In an embodiment, the pressure regulating device along the return line allows to control the pressure inside the second chamber. Indeed, by appropriately restricting the flow of working fluid inside the return line the pressure regulating device can be chosen so as to provide a higher pressure in the second chamber. Consequently, the entire system can be kept at a higher pressure than would otherwise be possible, so that recompressing the working fluid is no longer necessary after the separation.

The separating device can also include a reservoir configured to be pressurized at a predetermined operating pressure, which is higher than the pressure of the low pressure environment inside the turbine. This ensures that the working fluid can flow directly from the reservoir to the turbine.

The separating device also includes a heating device associated to the reservoir and configured to heat a mixture of lubricant and working fluid. Therefore, the separation of working fluid and lubricant can be performed at a higher pressure, as long as the working fluid has a lower boiling temperature than the lubricant.

The pressure regulating device can be an orifice configured to restrict the flow of the working fluid inside the return line. This allows to select a constructively simple solution if the pressure values in the second chamber and in the reservoir are known in advance and are not considered to be variable during the normal functioning of the turbine.

The pressure regulating device can alternatively be a regulating valve. This allows to adapt the flow inside the return line if the pressure conditions are expected to be variable.

BRIEF DESCRIPTION OF THE DRAWINGS

Further details and specific embodiments will refer to the attached figure. In the figure:

FIG. 1 is a schematic representation of an apparatus according to an embodiment of the invention.

DETAILED DESCRIPTION

The following description of exemplary embodiments refer to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Referring to the attached figures, with the number 1 is indicated an apparatus for sealing an internal environment of a turbomachine 100 according to an embodiment of the present invention.

The turbomachine 100 will be detailed only for ease of description of the apparatus 1, as it not per se part of the present invention. For example, the turbomachine 100 can be a turbine system adapted to operate according to the Organic Rankine Cycle (ORC).

The turbomachine 100 includes a turbine chamber 101. A turbine rotor 102 having a plurality of blades (not shown in the drawings) is placed inside the chamber 101. A shaft 103 is coaxially attached to the rotor 102, so as to extract work from the working fluid through the rotor 102. The shaft 103 is supported by bearings 107.

The turbomachine 100 also includes a lubrication circuit 106 of the shaft 103. Specifically, such lubrication circuit 106 is active on the above mentioned bearings 107, so that a lubricant can be used to lubricate and cool the bearings 107. The lubrication circuit 106 itself can be of known type and configuration, and will therefore not be described in further detail.

The apparatus 1 includes a first chamber 2. The first chamber 2 is connectable in fluid communication with a high pressure environment "HP" of the turbomachine 100. In this way, the working fluid can flow from the high pressure environment 100 to the first chamber 2.

In an embodiment, a second chamber 3 is placed in fluid communication with the lubrication circuit 106 through the bearings 107 of the shaft 103. In this way, the lubricant can flow from the lubrication circuit 106 to the second chamber 3.

Referring to FIG. 1, the chambers 2, 3 can be arranged around the shaft 103. Specifically, the first chamber 2 is placed next to the rotor 102, while the second chamber 3 is placed next to the bearings.

The first 2 and second chambers 3 are arranged in fluid communication with each other. Indeed, the working fluid can flow from the first 2 to the second chamber 3. In other words, in an operating condition the first chamber 2 contains working fluid at a higher pressure than the lubricant inside the second chamber 3. Therefore, a mixture of working fluid and lubricant is created inside the second chamber 3. Such mixture is drained from the second chamber 3 through a drain line 8. The components of the apparatus 1 which are placed downstream of the drain line 8 will be explained in a following part of the present disclosure.

With more detail, the apparatus 1 includes a seal 14 between the first 2 and the second chamber 3. Indeed, the first 2 and the second chambers 3 are in fluid connection by the leakage of working fluid through the seal 14. The presence of the seal 14 ensures a sufficient obstacle to the flow of working fluid to ensure that a pressure differential is kept between the first 2 and the second chamber 3.

Additionally, a further seal 15 is placed between the first chamber 2 and the high pressure environment (HP) of the turbomachine 100. Similarly, the fluid communication between the first chamber 2 and the high pressure environment "HP" happens through the further seal 15.

The apparatus 1 includes a return line 4 for the working fluid. Such return line is placed in fluid communication with the first chamber 2. The return line is also connectable in fluid communication with a low pressure environment "LP" of the turbomachine 101. In this way, the working fluid can flow from the first chamber 2 to the low pressure environment 101. In other words, the working fluid can flow from the high pressure environment "HP" to the first chamber 2 to the low pressure environment "LP" through the return line 4.

The apparatus includes a pressure regulating device 5 along the return line 4. The pressure regulating device 5 has the function of providing a predetermined pressure drop.

According to an embodiment of the invention, the pressure regulating device 5 is an orifice 6. Such orifice 6 is configured to restrict the flow of the working fluid inside the return line 4 in order to achieve the desired predetermined pressure drop.

In an alternative embodiment of the invention, the pressure regulating device 5 is a regulating valve (not shown). In this case, the regulating valve is continuously adjustable between an open configuration and a closed configuration. In the open configuration the flow of the working fluid inside the return line 4 is unrestricted. In the closed configuration of the regulating valve the return line 4 is totally obstructed. In this way it is possible to adjust the predetermined pressure drop while the turbomachine 100 is working.

The apparatus 1 also includes a separating device 7 in fluid communication with the second chamber 3. Such separating device 7 can be connected in fluid communication with the low pressure environment "LP" of the turbomachine 100. Indeed, the separating device 7 is configured to draw a mixture of lubricant and working fluid from the second chamber 3. Indeed, the above mentioned drain line 8 is in fluid communication with the second chamber 3 and with the separating device 7. The separating device 7 has the function to separate the working fluid from the lubricant.

In detail, the separating device 7 has a first outlet 9 for the working fluid. Such first outlet 9 is placed in fluid communication with the return line 4. Specifically, the outlet 9 is connected to the return line 4 downstream of the pressure regulating device 5. More in detail, a further return line 10 is attached to the separating device 7 and joins the return line 4 downstream of the pressure regulating device 5.

The separating device 7 includes a reservoir 11. Such reservoir 11 is configured to be pressurized at a predetermined operating pressure. Such predetermined operating pressure can be whatever is appropriate for the circumstances but higher than the pressure of the low pressure environment "LP". In an embodiment, the pressure inside the reservoir 11 is between 1 and 6 bar.

The separating device 7 includes a heating device 12 associated to the reservoir 11. Such heating device 12 has the function of heating the mixture of lubricant and working fluid. In this way the working fluid, which has a lower boiling point than the lubricant, evaporates. With further detail, the first outlet 9 is placed in a higher side of the reservoir 11 so that the vapor containing mainly working fluid can exit from the reservoir 11 without mixing again with liquid lubricant. A demister 16 is attached to the first outlet 9 and in fluid communication with the reservoir 11. The demister 16 is also placed in fluid communication with the further return line 10. In this way the droplets of working fluid can be removed from the vapor upstream of the further return line 10. Such demister 16 is by itself known to the person skilled in the art, and will therefore not be described in further detail.

A second outlet 13 is placed on a lower side of the reservoir 11. In this way, the fluid exiting the reservoir 11 through the second outlet 13 contains mostly oil. The second outlet 13 is connectable in fluid communication with an oil tank 108 which is part of the lubrication circuit 106.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for sealing an internal environment of a turbomachine, the apparatus comprising:

a first chamber in fluid communication with a first internal environment of the turbomachine and configured so that a working fluid flows from the first internal environment to the first chamber;

a second chamber in fluid communication with the first chamber to receive a first portion of the working fluid from the first chamber and in fluid communication with a lubrication circuit to receive a lubricant from the lubrication circuit;

a seal disposed between the first chamber and the second chamber, wherein the first portion of the working fluid flows therethrough from the first chamber to the second chamber;

a return line in fluid communication with the first chamber and with a second internal environment of the turbomachine, the second internal environment defining an internal pressure lower than a pressure of the first internal environment, wherein the return line is configured to transmit a second portion of the working fluid from the first chamber to the second internal environment;

a pressure regulating device along the return line configured to provide a predetermined pressure drop; and a separating device in fluid communication with the second chamber and in fluid communication with the second internal environment, the separation device configured to draw a mixture of lubricant and the first portion of the working fluid from the second chamber and to separate the first portion of the working fluid from the lubricant, wherein the separating device comprises a first outlet for the first portion of the working fluid and a reservoir having an internal pressure configured to be pressurized at a predetermined operating pressure higher than the pressure of the second internal environment.

2. The apparatus according to claim 1, wherein the first outlet of the separating device is connected to the return line downstream of the pressure regulating device.

3. The apparatus according to claim 1, wherein the predetermined operating pressure of the reservoir is between 1 and 6 bar.

4. The apparatus according to claim 1, wherein the mixture of lubricant and the first portion of the working fluid are heated in the separation device.

5. The apparatus according to claim 1, further comprising a further seal between the first chamber and the first internal environment.

6. The apparatus according to claim 1, wherein the pressure regulating device is in fluid communication with the reservoir.

7. The apparatus according to claim 6, wherein the pressure regulating device is an orifice configured to restrict the flow of the second portion of the working fluid inside the return line.

8. The apparatus according to claim 6, wherein the pressure regulating device is a regulating valve configured to restrict the flow of the second portion of the working fluid inside the return line.

9. The apparatus according to claim 8, wherein the regulating valve is continuously adjustable between an open configuration in which the flow of the second portion of the working fluid inside the return line is unrestricted and a closed configuration in which the return line is totally obstructed.

10. The apparatus according to claim 1, further comprising a demister attached to the first outlet and in fluid communication with the reservoir and with a further return line, the further return line attached to the separating device and in fluid communication with the return line via the pressure regulating device.

* * * * *